US010364960B2

(12) United States Patent
Nguyen et al.

(10) Patent No.: US 10,364,960 B2
(45) Date of Patent: Jul. 30, 2019

(54) LOW PROFILE LED LUMINAIRE WITH LOW BRIGHT TO DARK RATIO

(71) Applicant: CORDELIA LIGHTING, INC., Rancho Dominguez, CA (US)

(72) Inventors: Huan C. Nguyen, Placentia, CA (US); Aaron O'Brien, Los Alamitos, CA (US)

(73) Assignee: CORDELIA LIGHTING, INC., Rancho Dominguez, CA (US)

( * ) Notice: Subject to any disclaimer, the term of this patent is extended or adjusted under 35 U.S.C. 154(b) by 0 days.

(21) Appl. No.: 15/709,437

(22) Filed: Sep. 19, 2017

(65) Prior Publication Data

US 2019/0086056 A1 Mar. 21, 2019

(51) Int. Cl.

| | |
|---|---|
| ***F21S 8/04*** | (2006.01) |
| ***F21S 4/20*** | (2016.01) |
| ***F21V 5/04*** | (2006.01) |
| ***F21V 23/00*** | (2015.01) |
| *F21Y 115/10* | (2016.01) |

(52) U.S. Cl.
CPC ..... *F21V 5/04* (2013.01); *F21V 23/004* (2013.01); *F21Y 2115/10* (2016.08)

(58) Field of Classification Search
CPC .... F21S 8/046; F21S 8/04; F21S 8/026; F21S 4/20; F21S 4/28; F21V 23/003; F21V 23/009; F21V 15/01; F21K 9/23; F21K 9/27
See application file for complete search history.

(56) References Cited

U.S. PATENT DOCUMENTS

| | | | | |
|---|---|---|---|---|
| 3,211,905 | A * | 10/1965 | Picha | F21S 2/005 362/222 |
| 3,517,853 | A * | 6/1970 | Aikens | F21S 8/04 220/324 |
| 6,739,734 | B1 * | 5/2004 | Hulgan | F21S 8/02 362/217.05 |
| 7,281,816 | B2 * | 10/2007 | Suzuki | G02F 1/133603 362/231 |
| 8,038,314 | B2 | 10/2011 | Ladewig | |
| 8,256,921 | B2 | 9/2012 | Crookham | |
| 8,292,448 | B2 * | 10/2012 | Kim | F21S 2/005 362/311.02 |
| 8,382,340 | B2 * | 2/2013 | Boyer | F21S 8/02 362/147 |
| 8,550,666 | B2 * | 10/2013 | Kim | F21V 15/01 362/294 |

(Continued)

*Primary Examiner* — Ismael Negron
(74) *Attorney, Agent, or Firm* — Paul Y. Feng; One LLP

(57) ABSTRACT

A luminaire includes a housing having a back wall and several side walls, a diffuser provided at a front of the housing, and a plurality of LED strips disposed on the back wall of the housing. The height of the housing is less than 3 inches, with internal dimensions such that X:Y=1:7 and Z is <1.5 inch, wherein X is the minimum distance between one of the LED strips and the diffuser, Y is the maximum distance, along a plane parallel to the back wall, between a center of one of the LED strips to an edge of the back wall, and Z is the distance, along a plane parallel to the diffuser, between an edge of the back wall and a front edge of the side wall sharing the edge with the back wall. The LED strips are configured to have a Full Width Half Max beam angle $\alpha$>100°, and emit <50 lumens.

15 Claims, 2 Drawing Sheets

(56) References Cited

U.S. PATENT DOCUMENTS

| | | | | |
|---|---|---|---|---|
| 2006/0012989 | A1* | 1/2006 | Lee | G02F 1/133603 362/231 |
| 2006/0164858 | A1* | 7/2006 | Park | G02F 1/133603 362/561 |
| 2009/0034247 | A1* | 2/2009 | Boyer | F21S 8/033 362/225 |
| 2013/0070455 | A1* | 3/2013 | Tsui | F21S 8/026 362/235 |
| 2015/0055353 | A1* | 2/2015 | Hutchens | F16M 13/02 362/370 |
| 2017/0321852 | A1* | 11/2017 | Handsaker | F21S 8/026 |

* cited by examiner

LOW PROFILE LED LUMINAIRE WITH LOW BRIGHT TO DARK RATIO

CROSS-REFERENCE TO RELATED APPLICATIONS

This application is related to provisional application No. 62/380,358, filed Aug. 26, 2016, the contents of which are hereby incorporated by reference.

FIELD OF THE INVENTION

The present invention relates to residential and commercial lighting fixtures. In particular, the present invention relates to ceiling light fixtures or similar luminaires.

BACKGROUND OF THE INVENTION

Ceiling panel light fixtures have been known for many years. They typically have a square or rectangular shape where each panel includes two, four, or more fluorescent tubes aligned in parallel. The light panels are typically mounted to a ceiling of a home, office, hospital, retail store, etc. Reflectors located at the top of the panel re-direct light downward, through a glass or plastic lens, and into the living space below. Technology has progressed to a point where light emitting diodes (LEDs) of sufficient brightness, color rendition, and cost are attractive to the consumer, and as such, LEDs are now used in ceiling lighting panels.

SUMMARY OF THE INVENTION

The present invention in various preferred embodiments is directed to a luminaire such as a panel light fixture for mounting to a planar surface inside a dwelling. The dwelling may be a home, restaurant, shop, office, etc. The planar surface can be any generally flat surface such as a wall or ceiling, and if for a ceiling, the panel light may be installed as a flush mount fixture, or integrated in a T-grid drop ceiling.

In a preferred embodiment, when illuminated, the luminaire has a diffuser with the appearance to the consumer of having a reduced bright to darkness ratio. This greatly improves the lighting efficiency as well as the overall look of the light emitted, without the dark spots common to existing lighting fixtures.

The preferred embodiment luminaire includes a housing having a height of less than or equal to about 3 inches, a front and a back disposed opposite each other, and four sides. An LED light source is disposed on the housing back and emits visible light with a beam angle. Preferably, the LED light source includes a plurality of LED strips mounted parallel to each other. A translucent diffuser is disposed at the front, wherein the diffuser is capable of transmitting at least about 80% of the light entering the diffuser.

An optional support structure attaches the diffuser to the housing front, wherein the support structure is hingeably mounted to the housing so that the diffuser can be opened and rotated away from the luminaire by the installer or consumer.

Based on empirical studies, to achieve the reduced bright to darkness ratio, the present invention contemplates that the housing includes internal dimensions X, Y and Z, such that X:Y=1:7 when Z is <1.5". Further, the LED light source should be specified to provide a Full Width Half Max beam angle $\alpha>100°$, and the LED light source should emit <50 lumens. Consequently, the diffuser of the present invention luminaire has the appearance of a reduced, visible bright to dark ratio of equal to or less than about 8:1 when the LED light source is illuminated.

DETAILED DESCRIPTION OF THE PREFERRED EMBODIMENTS

Figure 1:
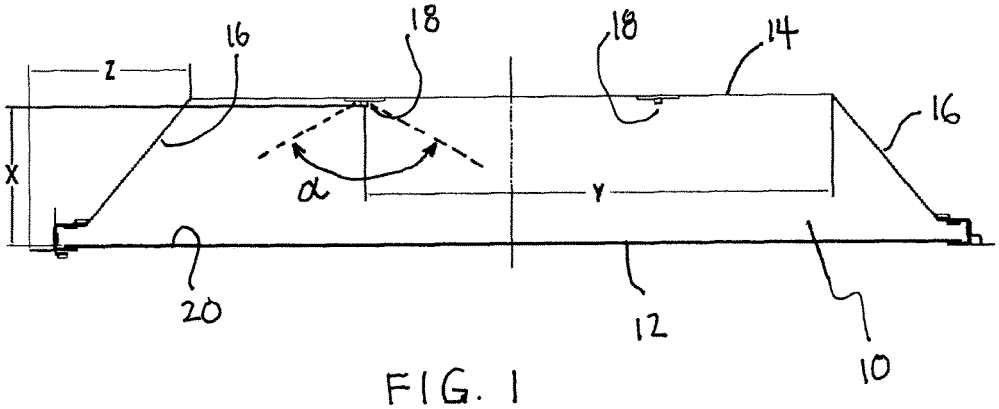
FIG. 1 is schematic side elevational view of a preferred embodiment luminaire.

The present invention in a preferred embodiment is directed to a panel light fixture kit for mounting to a planar surface inside a dwelling. The dwelling may be a home, restaurant, shop, office, etc. The planar surface can be any generally flat surface such as a wall or ceiling. If for a ceiling, the panel light may be installed as a flush mount fixture or integrated in a T-grid drop ceiling.

The transition from fluorescent light sources to LED sources is incremental. Currently many LED troffers or similar fixtures use hardware or structures that were made to accept a fluorescent tube. The height was in excess of 3 inches so that a person could reasonable replace a T8 lamp within the fixture. These fixtures are often retrofitted with strips of LEDs in place of the fluorescent lamps to simulate the familiar look of the fluorescent fixture. The consumer upgrades the energy savings potential of their building and the consumer still sees a familiar looking fixture.

The present invention is unique because the height of the troffer/luminaire is now reduced to be low profile (i.e., under 3 inches), but the bright to dark illumination uniformity ratio once generated by the fluorescent tubes has been preserved through careful selection and placement of the LEDs and other parameters. An LED only has a beam angle of typically 110 degrees. The fluorescent tube lamp, which is being replaced, had a 360-degree beam angle. This wide beam angle source not only provided illumination directly to the diffuser through the lens, but also reflected light within the luminaire to the lens reducing the ratio of bright to dark by reflecting a large amount of light within the luminaire, mostly off the top towards the diffuser.

Compared to the 360-degree beam angle of a fluorescent tube, the common LED has only a limited 110-degree beam angle. The LEDs need to be positioned so that a large portion of the reflected light within the luminaire is directed toward the sides of the fixture which can reflect light forward to help illuminate the lens or diffuser. The LED could also have an additional optic assembled in close proximity to the light emitting surface to change the beam angle wider than 110 degrees. This means a higher percentage of light will hit the inside of the luminaire without reflecting off of the diffuser first.

An LED with a beam angle greater than 110 degrees can also be selected to provide a distribution similar to the LED/optic assembly mentioned previously. Light directed toward the opposite side of the luminaire from the light source will also reflect and light up the inside top of the luminaire.

Those skilled in the art understand that the shorter the fixture gets, the more narrow the beam distribution will be when it enters the diffuser. Illuminated signs and other luminaires which need a diffuser which is uniform across the entire surface use a plurality of LEDs spaced so that the beam angles overlap slightly to cover the diffuser with light transmitted directly from the LED. Others add additional reflective surfaces to help homogenize the light reflected internally. Diffusers for these luminaire types typically only transmit 70% of the light directed into the diffuser. The absorbed light helps to diffuse the LED image and beam pattern.

The present invention, as seen the attached FIGS. 1-4, contemplates luminaires with diffusers preferably with about 80% or higher light transmission, and heights which have been reduced to lower costs since fluorescent tubes are no longer used.

In the preferred embodiments depicted in FIGS. 1-4, the present invention luminaire is less than or equal to about 3 inches, and more preferably about 2.75" in height, and is intended to be mounted on or within a planar surface such as a ceiling. This achieves a "low profile" aspect ratio for the luminaire/troffer housing to fit with or improve residential or commercial troffer applications. The luminaire includes a front (diffuser/lens side) and back (ceiling side) with four sides, with the front and back in general opposition to each other. The front consisting substantially of a diffuser able to transmit at least 80% of the light entering within the diffuser, and the back providing support for a light source, preferably an LED or a plurality of LEDs arranged in strips. The luminaire optionally includes support structure for the diffuser, wherein the support structure is hingeably mounted in a manner in which the diffuser can be opened and rotated away from the luminaire, and wherein the support structure is assembled in a manner which can be removed from the luminaire without tools. The luminaire when powered up with the LED light source illuminated, produces a visible bright to dark ratio of equal to or less than 8:1 at the diffuser as perceived by the consumer.

The present invention luminaire may include reflectors, but preferably uses reflective paint only inside the housing. The paint reflectivity is preferably greater than 70%.

One skilled in the art can appreciate the improvement in diffuser uniformity from the position of the LEDs and the consideration of the light reflected internally. This reduces the dark spaces on the diffuser/lens between the LED strips and the space between an LED strip and the outer edge of the luminaire. When the LED assembly has a beam angle wider than 115 degrees, the additional internal reflection inside the fixture further reduces the dark spaces on the diffuser between the LEDs and the LEDs to the outer edge.

There are LEDs which have a beam angle greater than 110 degrees; a chip scale LED has a beam angle of 150 degrees inherent to its construction. This reduces the light at nadir and projects a wider beam of light on the diffuser. If a lens is placed over an LED, it is possible to get a beam angle of 150 or slightly higher. With the reduction in candlepower at nadir, one can place the LED closer to the diffuser and still maintain a photometric value similar to an LED with a smaller beam angle. If the height of the fixture is reduced as in the present invention, having the wider beam would allow better uniformity than a standard beam angle of 110 degrees.

A chip-scale-LED eliminates an LED housing at the LED package level. The LED wafer is encapsulated with a medium so the LED can emit light without restrictions from an enclosure to hold the LED. Traditional LED's have a housing to hold the LED wafer and the cavity in which the LED sits is filled with a medium which has phosphors that emit white light. If one places a convex lens over this structure, the beam angle widens which reduces the candlepower at Nadir. The wider angle means that higher intensity light will be directed inside the luminaire rather than just the light coming from the weaker field angle. This higher intensity light will reflect off the internal surfaces and it will be directed to the diffuser Most diffusers have a critical angle of about 42.3 degrees. Above this angle from nadir, the light incident to the diffuser will begin to reflect. Placement of the LEDs relative to the reflective surfaces and other LED strips becomes critical to maintaining a bright to dark ratio of 8:1 or less.

Preferably, the diffuser has a thickness that is about 0.040" minimum. The distance from the LED for the diffuser is the space remaining on the inside of the enclosure from the inside surface of the diffuser to the face of the LED when the LED is mounted on a conducting surface which is in contact within the inside of the luminaire. It will be less than the overall height of the luminaire. Most diffusers with good uniformity of bright to dark use a diffuser with 70% light transmission, such as a backlit sign or a troffer with a white panel. The use of a diffuser lens with 80% transmission in a troffer with the present invention shallow depth yet still maintain 8:1 bright to dark uniformity ratio is unique. The present invention in a preferred embodiment is directed to such a luminaire with this height using just two LED strips can maintain this uniformity of 8:1 bright to dark ratio.

The diffusers, for the sake of this invention, are generally polymeric so the critical angle is close for all materials. The size of the luminaire for the preferred embodiment luminaire, which is a troffer, is dictated by the fact that the troffer needs to fit within a grid ceiling. This restriction is the starting parameter for mounting of the LED and the related components. Traditional troffers have a ballast cover running parallel with the lamps and this provides an electrical enclosure for the connection of the input supply to the ballast. That structure creates a shadow and makes the look of the diffuser less uniform, so in the preferred embodiment, it was moved to an edge and it is arranged perpendicular to the LED strips. The shadow was eliminated.

The interior paint used in the preferred embodiment is for corrosion resistance and the reflective properties are generally 70% or greater reflectivity and the reflection is generally Lambertian so that hot spots are not generated on the diffuser. The sides which are parallel with the LED strip are angled as needed per the fixture height to redirect the high angle light back toward the diffuser. This method of design would have been similar with fluorescent tubes, but the tube had a 360-degree beam angle so the construction was optimized to allow installation and removal of the lamps and redirect the light from the high angles (90-degrees from nadir and above) towards the diffuser. Lambertian reflection was contemplated for the present invention construction as well.

Inside the luminaire, preferably two LED strips are located on the same center line spacing as what was used for fluorescent housings, which is typically between 9" and 10" between lamps. If the LED strips, two, three, or four, are mounted roughly equidistant so that the spaces between are relatively uniform, the results will maintain uniformity. With two LED strips, the distance between ranges between 7" and 9" depending the fixture construction. With two LED strips, the distance between the first strip and the sidewall is equal to the distance between the fixture centerline and the LED centerline. The distance between the farthest side of the fixture sidewall is roughly double the distance between the fixture centerline and the LED centerline.

The present invention maintains a preferred bright to dark uniformity ratio of about 8:1 or less. The ratio was not checked at anything other than full brightness of the LEDs. From empirical observations, the intensity and spacing of the LED are important factors. The center-to-center distance is roughly 1" or less on a linear strip and the LED, with a beam angle of 100 degrees or greater, should preferably be 44 lumens or less for typical residential or commercial lighting environments. A wider-angle LED or an LED with a primary lens to widen the beam can have 20% more lumens and maintain this ratio. It has been observed empirically that the present invention has achieved a 6:1 bright to dark ratio.

FIG. 1 is a schematic view of a preferred embodiment luminaire having housing 10. The luminaire housing 10 includes a housing with a front 12, back 14, and several sides 16. There are preferably four sides 16 to the housing, which has a polygonal shape, but more or fewer sides as well as other shapes are contemplated. The sides 16 are sloped to reflect light down toward the front. The back of the housing 14 is mounted to a wall or ceiling, and is the support surface for the LED light source 18. In the preferred embodiment, there are two parallel LED light strips 18 functioning as the light source. Of course, there can be more or fewer LED light strips, or chip-scale or like LEDs mounted directly to the back. The front 12 of the housing 10 is covered by the lens/diffuser 20. This side faces down into the room if the luminaire is mounted to or within a ceiling, so the diffuser 20 is exposed and visible to the consumer residing inside the room.

Still in FIG. 1, the housing 10 has several physical dimensions—because sides 16 are sloped, housing dimensions X and Z define two legs of a 90-degree triangle, with the hypotenuse corresponding to the sloped housing side 16. Also, dimension Y is the distance of an LED light source 18 to the farther side 16. These dimensions are usually expressed in inches.

In FIG. 1, the LED light source 18 provides a Full Width Half Max (FWHM) beam angle $\alpha$. Full Width Half Max means, when the candlepower is measured at different angles from nadir, center, the point at which the candlepower drops to 50% of the nadir value is the full width half max value. The LED light source 18 has a package output expressed in lumens. Based on empirical studies, the present invention preferably follows the design parameters below to achieve the claimed results, as expressed by:

X:Y=1:7 when Z is <1.5" and LED FWHM Beam Angle $\alpha$>100° and LED package output <50 lumens.

When the above design parameters are followed, the brightness-to-darkness ratio or light non-uniformity will be no more than about 8:1, based on empirical testing. This is a reasonable ratio with a very pleasing and acceptable appearance to the consumer. In other words, the dark spots of the LED luminaire are essentially eliminated or imperceptible to the consumer. The light output is visibly uniform and provides efficient illumination.

Figure 4:
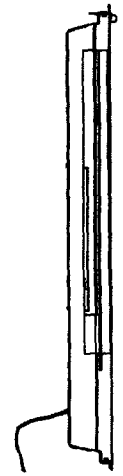
FIG. 4 is an end view of the luminaire from FIGS. 2 and 3.
Figure 2:
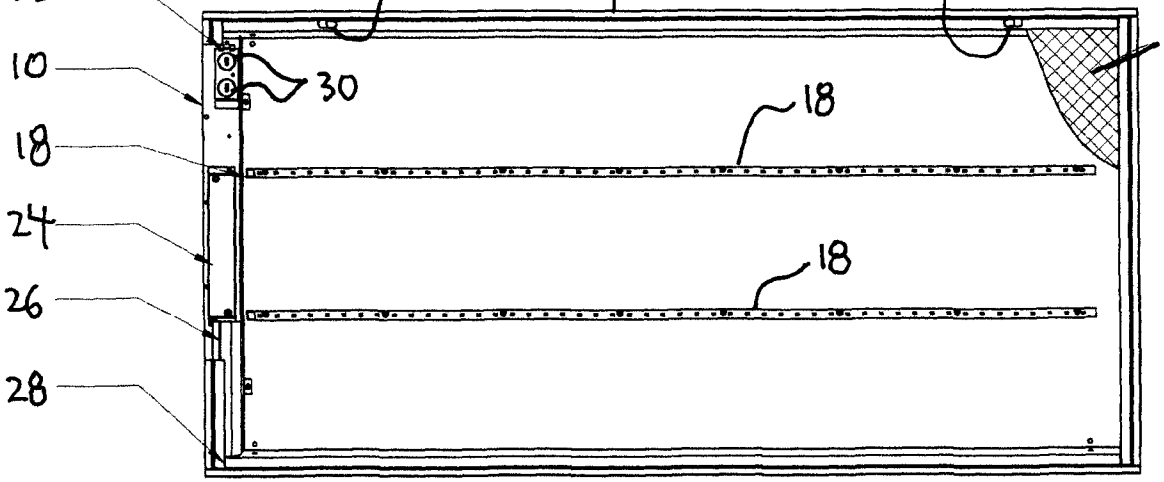
FIG. 2 is a plan view of a preferred embodiment luminaire.
Figure 3:
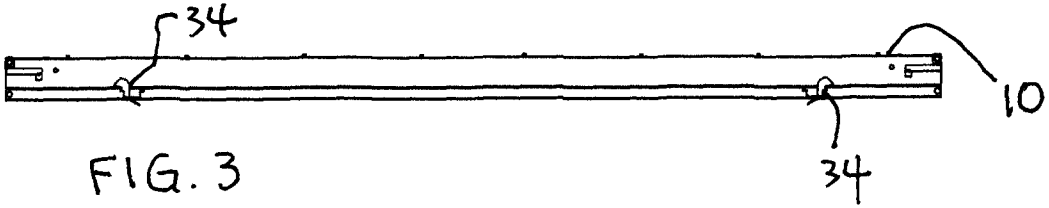
FIG. 3 is a side elevational view of the luminaire from FIG. 2.

FIGS. 2-4 provide top, side and edge views of a preferred embodiment luminaire, employing the design parameters above. The top plan view of FIG. 2 shows a rectangular shaped pan housing 10 with four sides. The preferred embodiment includes two LED strips 18 mounted to the back. Partially shown in cross-hatch at the front is the lens or diffuser 20.

Along the left side of the housing 10 in FIG. 2 are a wire connection box 22 which contains the power supply leads into the luminaire; an enclosure for the LED driver 24, which serves as the power supply and the AC-to-DC converter for the LED strips 18; an optional LED driver cover plate 26; and the frame 28 of the housing. The wire connection box 22 optionally includes one or more knock-outs 30, which are pre-scored areas on the box that can be punched out by the installer as needed for access to wiring. With the electrical connection box 22 positioned at one side of the housing 10, there are no shadows being cast by the box 22 on to the diffuser 20, thereby avoiding unwanted dark spots.

The diffuser 20 is optionally mounted to the housing 10 using one or more hinges 32, that allows the diffuser to swing away from the housing. As seen in FIG. 3, optional cam lock levers 34 are located on the housing frame 28 with a pivot axis located generally parallel with the LED strips 18. These cam lock levers 34 hold the swing away diffuser to the housing 10. These swinging and locking components can be omitted, so the diffuser can be friction, interference, or snap fit to the housing, or simple screws or like fasteners can be used to hold everything in place.

While particular forms of the invention have been illustrated and described, it will be apparent that various modifications can be made without departing from the spirit and scope of the invention. It is contemplated that components from one embodiment may be combined with components from another embodiment.

What is claimed is:

1. A luminaire comprising:

a polygonal shaped housing having a front wall and a back wall disposed opposite each other, and a plurality of side walls;

an LED light source disposed on the back wall and emitting visible light at least than 50 lumens, with a Full Width Half Max beam angle $\alpha$>100°;

a diffuser disposed at the housing front, the diffuser able to transmit at least 80% of the light entering the diffuser to achieve a substantially uniform illumination output when the LED light source is illuminated;

wherein the housing is dimensioned such that X:Y=1:7 when Z<1.5 inches, where X is the minimum distance between the LED light source and the diffuser, Y is the maximum distance between a center of the LED light source and an edge of the back wall measured along a plane parallel to the back wall, and Z is a distance between an edge of the back wall and a front edge of a side wall measured along a plane parallel to the back wall.

2. The luminaire of claim 1, wherein the power supply enclosure includes an LED driver.

3. The luminaire of claim 1, wherein the housing includes a height of about 2.75 inches.

4. The luminaire of claim 1, wherein the housing interior includes a reflective coating.

5. The luminaire of claim 4, wherein the reflectivity of the reflective coating is greater than about 70%.

6. The luminaire of claim 1, wherein the LED light source includes a plurality of LED light strips.

7. The luminaire of claim 6, wherein the luminaire includes a power supply enclosure disposed at one side of the luminaire and perpendicular to the LED strips.

8. The luminaire of claim 7, wherein the power supply enclosure includes an AC-to-DC converter.

9. The luminaire of claim 6, wherein the luminaire includes at least one access plate located on the back wall of the housing, arranged perpendicular to the LED strips, for access to the a power supply.

10. The luminaire of claim 9, wherein the at least one access plate includes pre-scored knock-outs.

11. A luminaire comprising:

a housing having a back wall and four walls;

an LED light source disposed on the back wall and emitting visible light at less than 50 lumens, with a Full Width Half Max beam angle $\alpha>100°$;

a diffuser disposed at the front, the diffuser able to transmit at least 80% of the light entering the diffuser to achieve a bright to dark ratio of equal to or less than about 8:1 when the LED light source is illuminated;

a support structure hingeably coupling the diffuser to the housing front, such that the housing can be opened by pivoting the diffuser away from the luminaire, wherein the housing is dimensioned such that $H\leq 3$ inches, and $X:Y=1:7$ when $Z<1.5$ inches, where H is a height of the housing, X is the minimum distance between the LED light source and the diffuser, Y is the maximum distance between a center of the LED light source and an edge of the back wall measured along a plane parallel to the back wall, and Z is a distance between an edge of the back wall and a front edge of a side wall measured along a plane parallel to the back wall.

12. The luminaire of claim 11, wherein the LED light source includes an LED assembly with a beam angle of greater than about 100 degrees.

13. The luminaire of claim 11, wherein the luminaire includes a power supply enclosure mounted perpendicular to the LED light source.

14. The luminaire of claim 11, wherein the LED light source includes at least one LED strip mounted substantially parallel to at least one side of the housing, and wherein a length of the LED strip extends substantially the entire length of the one side of the housing.

15. The luminaire from claim 14, wherein the support structure includes a cam lock lever located with a pivot axis located generally parallel with the LED strips.

* * * * *